US008925338B2

(12) United States Patent
Roekens

(10) Patent No.: US 8,925,338 B2
(45) Date of Patent: Jan. 6, 2015

(54) CHEST COOLER

(75) Inventor: Jurgen Roekens, Kampenhout (BE)

(73) Assignee: The Coca-Cola Company, Atlanta, GA (US)

( * ) Notice: Subject to any disclaimer, the term of this patent is extended or adjusted under 35 U.S.C. 154(b) by 157 days.

(21) Appl. No.: 13/074,080

(22) Filed: Mar. 29, 2011

(65) Prior Publication Data

US 2011/0239675 A1 Oct. 6, 2011

Related U.S. Application Data

(63) Continuation-in-part of application No. 12/752,247, filed on Apr. 1, 2010.

(51) Int. Cl.

| | |
|---|---|
| ***A47F 3/04*** | (2006.01) |
| ***A47F 3/00*** | (2006.01) |
| ***A47B 81/00*** | (2006.01) |
| ***F25D 23/02*** | (2006.01) |

(52) U.S. Cl.

CPC ..... *F25D 23/026* (2013.01); *A47F 3/0404* (2013.01)

USPC ..... 62/252; 62/251; 62/246; 62/457.4; 62/457.5; 62/249; 312/290; 312/116; 312/117

(58) Field of Classification Search

CPC ..... F25D 23/026; F25D 23/028; F25D 23/04; F25D 25/00; F25D 2325/021; A47F 3/00; A47F 3/04; A47F 3/043; A47F 3/0404

USPC ..... 62/251, 252, 246, 249, 457.4, 457.5; 312/116, 117, 138.1, 290

See application file for complete search history.

(56) References Cited

U.S. PATENT DOCUMENTS

| | | | | |
|---|---|---|---|---|
| 777,895 | A | 12/1904 | Geraci | |
| 1,275,511 | A * | 8/1918 | Welch | 312/292 |
| 1,701,019 | A | 2/1929 | Summers | |
| 1,709,080 | A | 4/1929 | Krueger | |
| 1,924,494 | A * | 8/1933 | Gelinas | 190/12 R |
| 2,341,183 | A * | 2/1944 | Loewy | 62/258 |
| 2,722,807 | A * | 11/1955 | Downing | 62/336 |
| 2,905,535 | A | 9/1959 | Fredrick | |
| 2,938,363 | A * | 5/1960 | Dickinson et al. | 62/249 |
| 3,133,427 | A * | 5/1964 | Petkwitz | 62/227 |
| 3,304,740 | A * | 2/1967 | Balk et al. | 62/256 |
| 5,549,373 | A * | 8/1996 | Bustos | 312/135 |
| 5,624,098 | A * | 4/1997 | McDowell | 248/550 |
| 6,094,934 | A | 8/2000 | Rand et al. | |

(Continued)

FOREIGN PATENT DOCUMENTS

| | | | | |
|---|---|---|---|---|
| AU | 2008 100 686 A4 | | 8/2008 | |
| DE | 10 2008 005445 A1 | | 7/2009 | |
| DE | 102008005445 | * | 7/2009 | B67B 7/16 |
| FR | 2 665 621 A1 | | 2/1992 | |

*Primary Examiner* — Frantz Jules
*Assistant Examiner* — Joseph Trpisovsky
(74) *Attorney, Agent, or Firm* — Sutherland Asbill & Brennan LLP

(57) ABSTRACT

The present application and the resultant patent provide a chest cooler for dispensing a number of products. The chest cooler may include an outer frame, a number of product compartments within the outer frame, an upper door, and a front door. The front door may include a transparent panel. Some or all of the products are accessible via either the upper door or the front door and visible through the transparent panel.

20 Claims, 7 Drawing Sheets

(56) References Cited

U.S. PATENT DOCUMENTS

| | | | | |
|---|---|---|---|---|
| 6,266,963 | B1 * | 7/2001 | Rudick | 62/6 |
| 6,351,964 | B1 * | 3/2002 | Brancheau et al. | 62/249 |
| 6,547,349 | B2 | 4/2003 | Sessa et al. | |
| 6,672,092 | B2 | 1/2004 | Ruiz et al. | |
| 7,150,163 | B1 * | 12/2006 | McAllister | 62/389 |
| 7,377,125 | B2 | 5/2008 | Seiden et al. | |
| 7,591,144 | B2 | 9/2009 | Wilson et al. | |
| 2004/0073334 | A1 | 4/2004 | Terranova | |
| 2007/0241645 | A1 * | 10/2007 | Trulaske | 312/116 |
| 2008/0148753 | A1 | 6/2008 | Welker et al. | |
| 2008/0218038 | A1 | 9/2008 | Wood et al. | |
| 2009/0001861 | A1 | 1/2009 | Welker et al. | |
| 2009/0173101 | A1 | 7/2009 | Hynes | |
| 2009/0183515 | A1 | 7/2009 | Hale et al. | |
| 2010/0152892 | A1 * | 6/2010 | Gavra et al. | 700/232 |

* cited by examiner

CHEST COOLER

RELATED APPLICATIONS

The present application is a continuation-in-part of U.S. application Ser. No. 12/752,247, entitled "Chest Cooler," filed on Apr. 1, 2010, now pending. U.S. application Ser. No. 12/752,247 is incorporated by reference herein in full.

TECHNICAL FIELD

The present application relates generally to refrigeration systems and more particularly relates to a low cost, low energy chest-type cooler with a number of product sections.

BACKGROUND OF THE INVENTION

Although modern vending machines and coolers offering beverages and other types of products may seem ubiquitous, many retail establishments throughout the world still rely on ice chests and the like to keep products refrigerated and cooled. Such retail establishments may lack sufficient space for conventional electrical coolers or the sales volume may not justify the cost of such coolers. Likewise, the energy required to run such coolers also may be of concern.

The use of conventional ice chests, however, often results in inconsistent product quality. Specifically, the retailer must fill the chest with ice in order to keep the products therein cold. Likewise, loss or pilferage from the ice chests may be high given the usual lack of a locking mechanism. Moreover, ice chests generally do not drive impulse purchases because the consumer cannot see the products therein. Even when the ice chest is opened, a customer may only see the top several products therein while additional and/or different types of products may be beneath the top layer or within the ice.

There is thus a desire therefore for improved chest cooler. Such a chest cooler preferably would be low cost, with low energy consumption, remain relatively compact, but provide the visual appeal more often associated with glass door coolers and the like.

SUMMARY OF THE INVENTION

The present application and the resultant patent thus provide a chest cooler for dispensing a number of products. The chest cooler may include an outer frame, a number of product compartments within the outer frame, an upper door, and a front door. The front door may include a transparent panel. Some or all of the products are accessible via either the upper door or the front door and visible through the transparent panel.

The present application and the resultant patent further provide a chest cooler for dispensing a number of products. The chest cooler may include an outer frame, a first product compartment within the outer frame, an upper door positioned about the first product compartment, a second product compartment within the outer frame, and a front door positioned about the first product compartment and the second product compartment. The front door may include a transparent panel. Some or all of the products are accessible via either the upper door or the front door and visible through the transparent panel.

These and other features and improvements of the present application and the resultant patent will become apparent to one of ordinary skill in the art upon review of the following detailed description when taken in conjunction with the several drawings and the appended claims.

DETAILED DESCRIPTION

The present application concerns the offering for sale of any number of products 10. Although the products 10 are shown, by way of example only, in the form of bottles, it is understood that the products 10 may include any type or size of item or package including, but not limited to, bottles, cans, pouches, boxes, wrapped items, produce, and/or any type of rigid or flexible packing. The products 10 may include beverages, food items, non-food items, consumer products, and/or any type of product. The scope of the application is in no way limited by the nature of the products 10 intended to be offered herein or otherwise.

Figure 1:
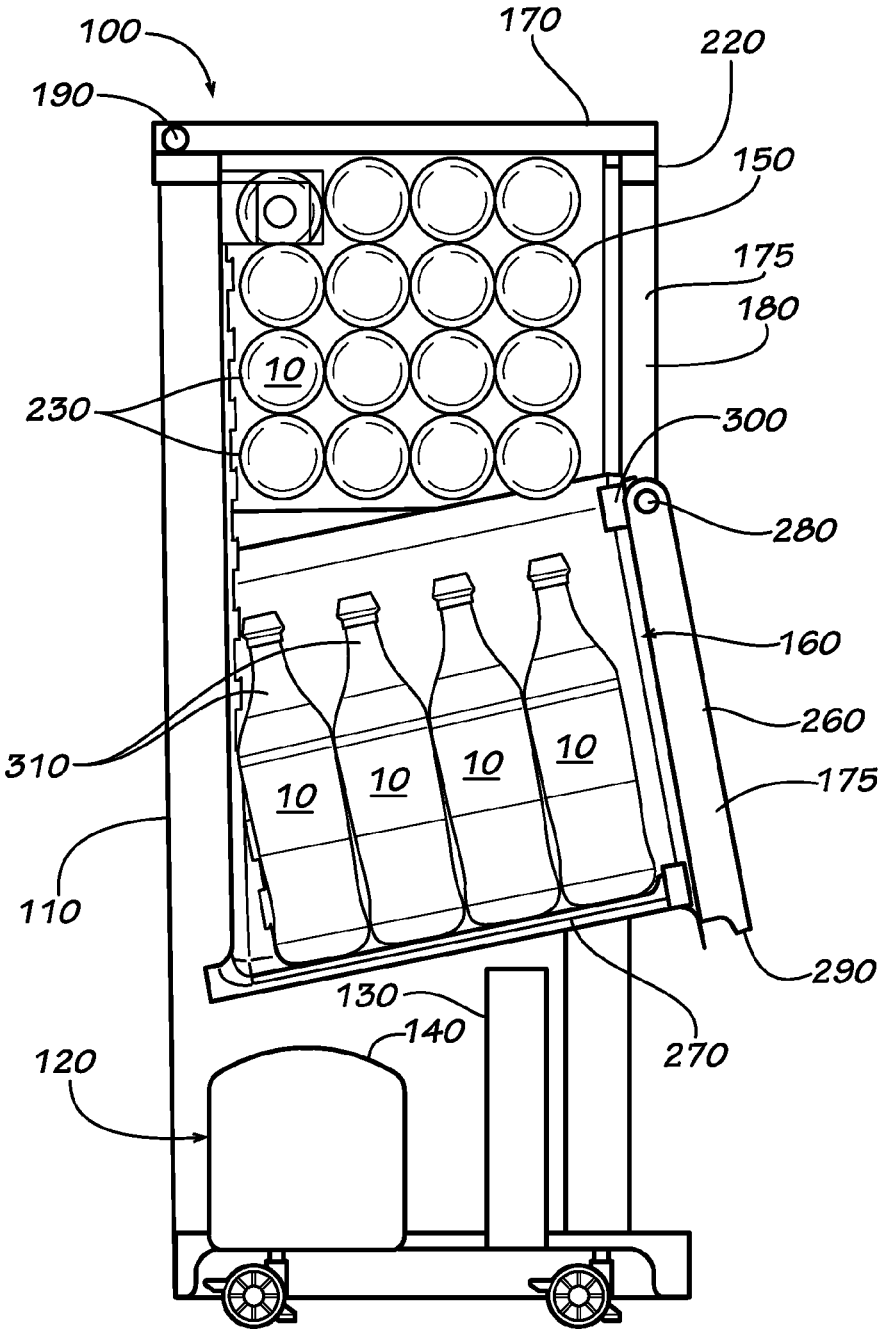
FIG. 1 is a side cross-sectional view of a chest cooler as is described herein.

Referring now to the drawings in which like numerals refer to like elements throughout the several views, FIG. 1 shows a chest cooler 100 as may be described herein. The chest cooler 100 may include an outer frame 110. The outer frame 110 may be insulated. The outer frame 110 and the chest cooler 100 as a whole may have any desired size or shape.

A refrigeration device 120 may be positioned within or about the outer frame 110. The refrigeration device 120 may be of conventional design and may include a fan 130, a compressor 140, and other types of refrigeration components. Alternatively, a freezing device and/or a heating device also may be used herein with or without the refrigeration device 120. The refrigeration device 120 may be modular and/or original equipment.

The chest cooler 100 may include a number of product compartments. In this example, a first product compartment 150 and a second product compartment 160 may be used. Any number of product compartments may be used herein. The first product compartment 150 may be bounded by an upper door 170 and a front panel 180. The upper door 170 may pivot upward via an upper door hinge 190 and the like. The upper door hinge 190 may be positioned on any side of the upper door 170. The upper door 170 also may have an upper door handgrip 200. The upper door 170 may be transparent or opaque. If transparent, a transparent panel 175 may be used. Various types of messaging 210 may be positioned on the upper door 170. Any type of messaging 210 may be used herein. Examples include brand advertising, pricing, instructions for use, etc. The first product compartment 150 and the upper door 170 may have any shape or size. A gasket layer 220 may be positioned about the upper door 170 so as to ensure an airtight seal when closed. Other types of insulation also may be used herein.

The front panel 180 may be fixed in place. The front panel 180 may be transparent or opaque. If transparent, the transparent panel 175 may be used. The front panel 180 preferably may be transparent such that a consumer can see the products 10 within the first compartment 150. The front panel 180 also may be opaque with the messaging 210 thereon. The front panel 180 may have any shape or size.

In this example, the products 10 may have a horizontal position 230 within the first product compartment 150. A compartment divider 240 may divide the first product compartment 150 into a number of sections 250. Any number of compartment dividers 240 and sections 250 may be used herein. A vertical position or any orientation of the products 10 also may be used herein. Any number of products 10 may be positioned therein. The first section 250 may include one type of product 10 and the second section 250 may include a different type of product 10.

The second product compartment 160 may be bounded by a front door 260 and a slanted floor 270. The front door 260 may pivot open via a front door hinge 280 and the like. The door hinge 280 may be positioned on any side of the front door 260. The front door 260 also may include a front door handgrip 290 and a front door gasket layer 300. The front door 260 may be transparent with the transparent panel 175 such that a consumer may see the products 10 therein. Alternatively, the front door 260 may be opaque. The front door 260 also may include the messaging 210 thereon. The slanted floor 270 may have any desired angle but is preferably slanted upward such that a consumer has a good view of the products 10 therein. The products 10 may have a substantially vertical position 310 therein. A horizontal position or any orientation of the products 10 also may be used herein. Any number of products 10 may be positioned therein. The second product compartment 160 and the front door 260 may have any shape or size.

Figure 3:
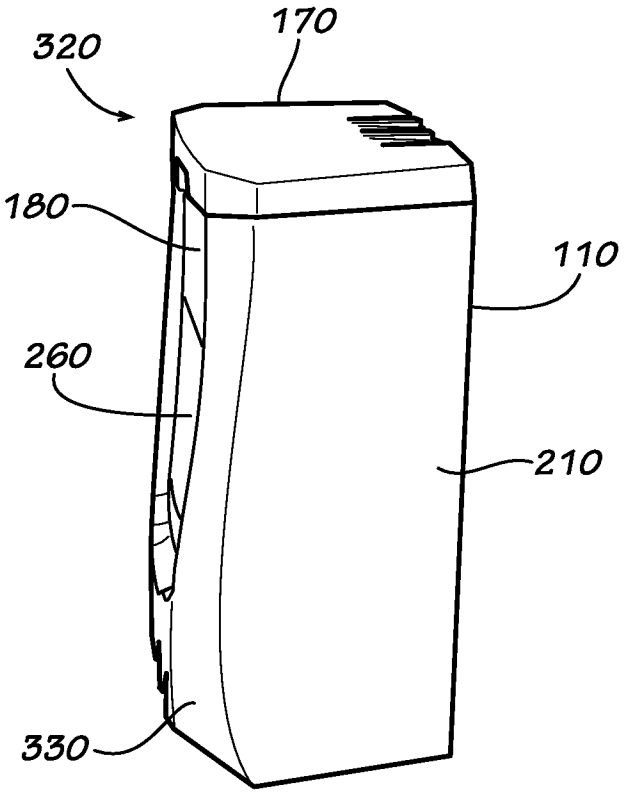
FIG. 3 is a side perspective view of the embodiment of the chest cooler of FIG. 2.
Figure 2:
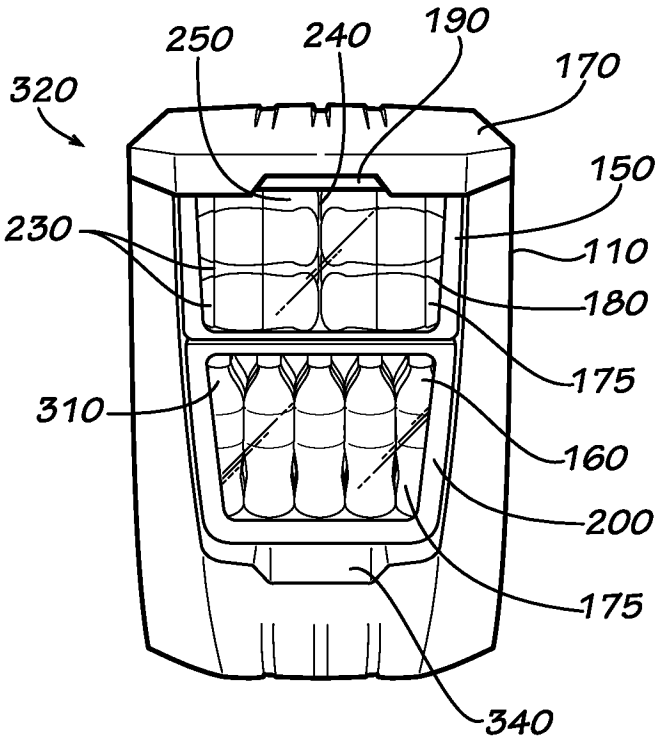
FIG. 2 is a front perspective view of a further embodiment of the chest cooler as may be described herein.

FIGS. 2 and 3 show a further embodiment of a chest cooler 320. In this embodiment, the upper door 170 is opaque while the front panel 180 and the front door 260 are transparent and use the transparent panels 175. The outer frame 110 may have the messaging 210 thereon. Moreover, the outer frame 110 has a contour 330 that resembles the Dynamic Ribbon Device of The Coca-Cola Company of Atlanta, Ga. In this example, the outer frame 110 also includes a hand indent 340 positioned beneath the front door 260. The hand indent 340 also may be positioned at the side of the front door depending upon where the door hinge 280 is located. The handgrip 200 or a handle also may be used.

In use, the products 10 are loaded into the first product compartment 150 and the second product compartment 160 of the chest cooler 100. The products 10 in the first product compartment 150 may have the horizontal position 230 while the products 10 in the second product compartment 160 may have the vertical position 310. Alternatively, all of the products 10 may have the horizontal position 230, the vertical position 310, or combinations thereof.

The use of the transparent panels 175 on the front panel 180, the front door 260, and elsewhere allows consumers to see the products 10 therein. Moreover, the transparent panels 175 allow the consumers to see the entire front column of the products 10 in the first product compartment and the first row of the products 10 in the second product compartment 160. This visibility is further improved by the slanted floor 270 that angles the products 10 toward the consumer. Such visibility may spur consumer interest in the products 10 therein and/or promote impulse purchases. The improved visibility also may provide brand differentiation with the products 10 therein. This consumer interest may be further spurred by the use of the messaging 210 as well as the contoured shape 330.

A consumer thus may open the upper door 170 on the first product compartment 150 and/or open the front door 260 of the second product compartment 160 and remove a product 10 therefrom. Other compartments and other types of access point may be used herein. The chest cooler 100 thus provides easy access to the products 10 therein while providing improved visibility.

The upper door 170 and the front door 260 may have a locking device thereon. One or more chest coolers 100 may be stacked together and/or multiple chest coolers 100 may be used. The products 10 may be positioned in a basket. The basket may be removable from the first product compartment 150 and/or the second product compartment 260 so as to permit first in first out loading. Other types of loading techniques also may be used herein.

The relatively small size of the chest cooler 100 as a whole along with the use of the gasket layers 220, 300 about the upper door 170, the front door 260, and elsewhere also should make the overall chest cooler 100 reasonably energy efficient. The size of the transparent panels 175 may be minimized so as to reduce overall energy consumption. The refrigeration device 120 also avoids the need to refill the chest cooler 100 with ice.

Figure 4:
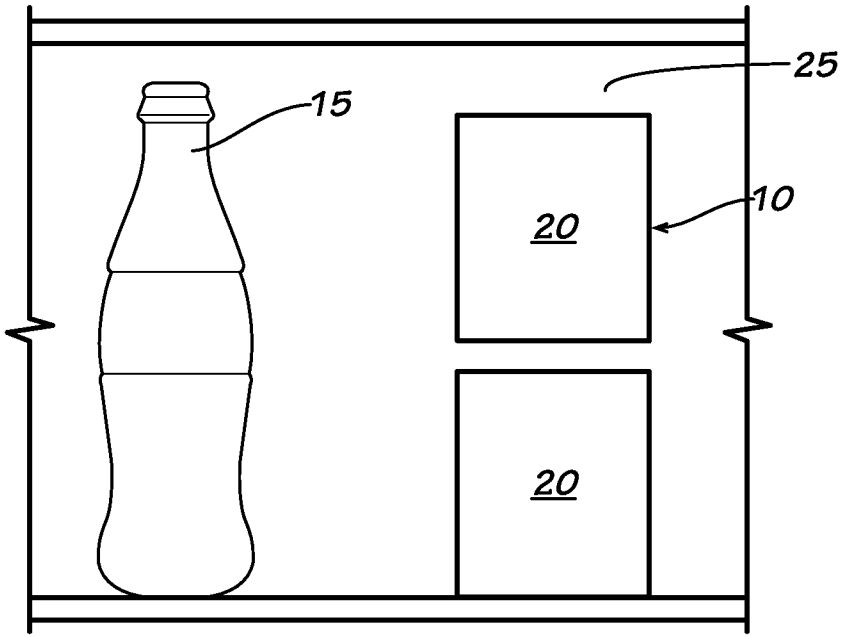
FIG. 4 is a schematic view of a known cooler with fixed shelf spacing for battles or cans.

Traditional coolers generally included shelves of a fixed height or distance therebetween. In the beverage industry, this fixed height generally accommodates either the height of a single bottle 15 or the height of a pair of cans 20 as well as a limited clearance gap 25 as is shown in FIG. 4. If a single row of cans 20, however, is used, the overall cooler may have a significant amount of unused space therein. Moreover, traditional coolers generally cannot accommodate product containers of varying height. As such, a cooler built to accommodate product containers from one country may not accommodate product containers intended for use in another country without unused space therein.

Figure 5:
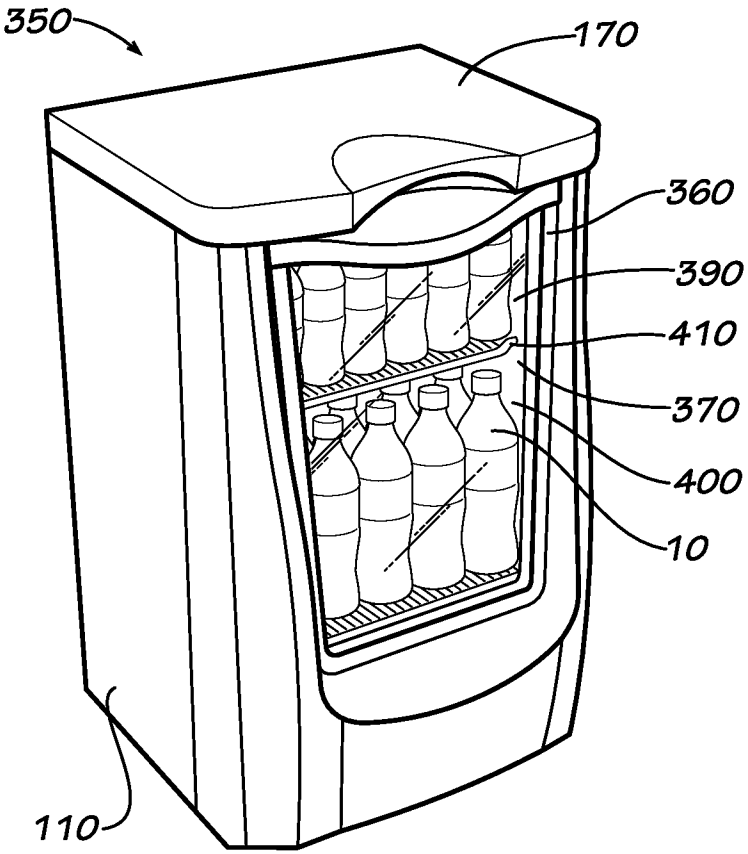
FIG. 5 is a front perspective view of a further embodiment of the chest cooler as may be described herein.

FIG. 5 shows an embodiment of a chest cooler 350 as may be described herein. Similar to that described above, the chest cooler 350 may include the outer frame 110 with the refrigeration device 120 positioned therein. The outer frame 110 also may include the contoured shape 330 or other shape. Likewise, the chest cooler 350 may include the upper door 170. The upper door 170 may include the upper door handgrip 200. The chest cooler 350 also may include a front door 360. The front door 360 may have an elongated shape with a transparent panel 370. The front door 360 may extend for most of the length of the outer frame 110. Given such, the front panel 180 therefore may not be used in this example. Other components and other configurations may be used herein.

The chest cooler 350 described herein thus may include a number of varying height product compartments 380. Although a first product compartment 390 and a second product compartment 400 are shown, any number of the variable height product compartments 380 may be used herein. Each variable height compartment 380 may include one or more variable shaves 410. The variable shelves 410 may be positioned on a number of shelf ledges 420. Positioning the variable shelves 410 thus may change the height of the variable height product compartments 380 by moving a shelf 410 from a first shelf ledge 430 to a second shelf ledge 440. Any number of shelf ledges 420 may be used herein in any configuration. The shelf ledges 420 may be positioned such that the shelves 410 maintain a slanted orientation 450 for improved visibility.

Figure 6B:
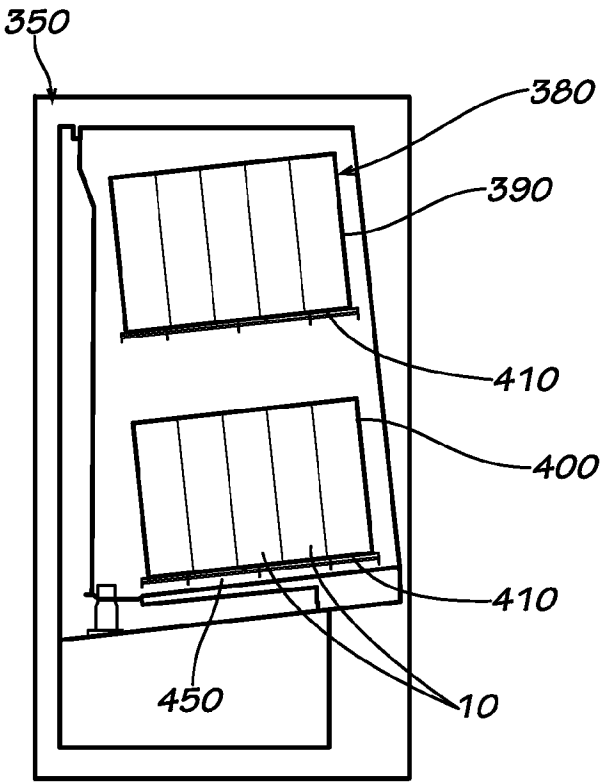
FIG. 6B is a partial side view of the chest cooler of FIG. 5.
Figure 6A:
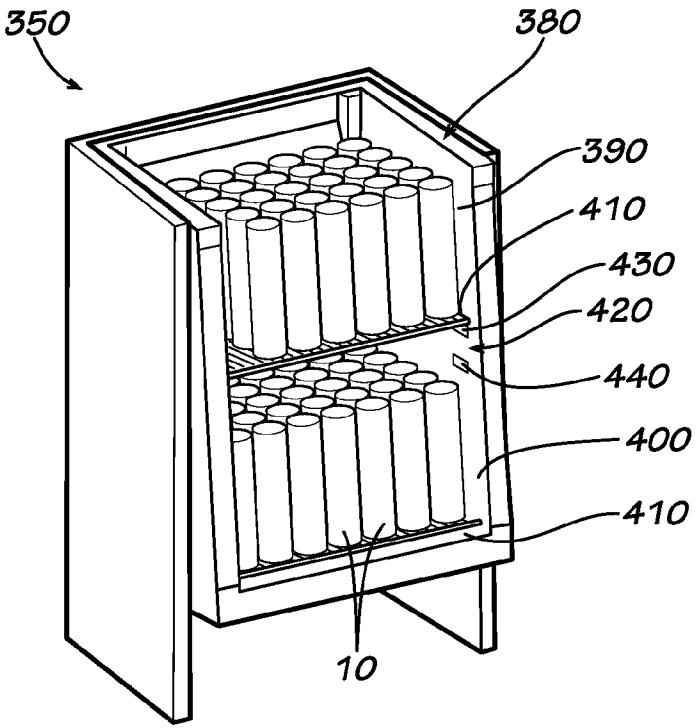
FIG. 6A is partial front perspective view of the chest cooler of FIG. 5.
Figure 7B:
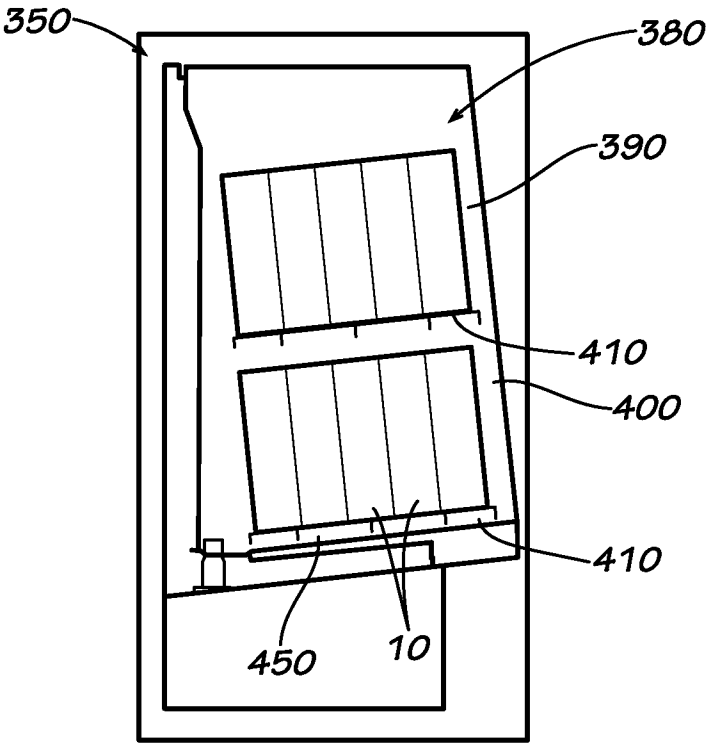
FIG. 7B is a partial side view of the chest cooler of FIG. 5.
Figure 7A:
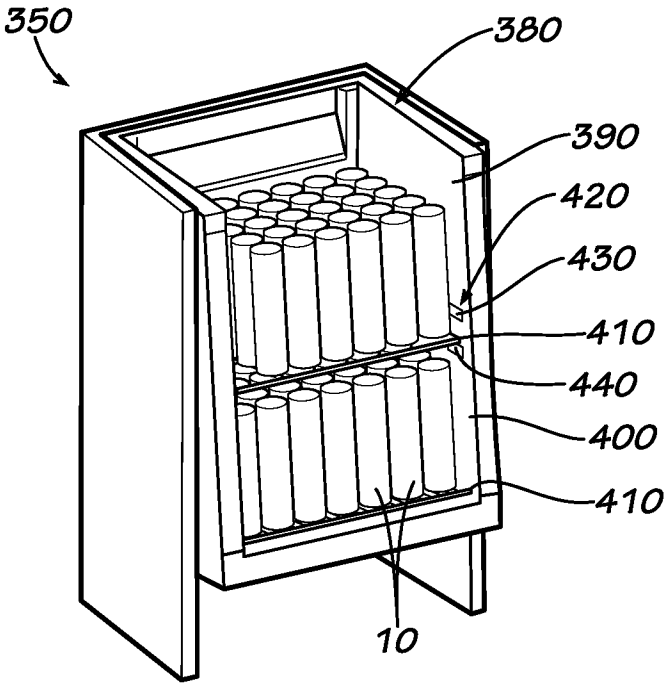
FIG. 7A is partial front perspective view of the chest cooler of FIG. 5.

As shown in FIGS. 6A and 6B, the variable shelf 410 may be positioned on the first shelf ledges 430 so as to reduce the height of the first product compartment 390. Given the use of the upper door 170, less of a clearance 25 may be required therein. This additional space also allows the products 10 in the second product compartment 420 to be viewed clearly via the front door 360, Likewise as is shown in FIGS. 7A and 7B, the variable shelf 410 may be positioned on the second shelf ledges 440 so as to decrease the size of the second product compartment 400. The variable product compartments 380 thus not only provide increased visibility but also the ability to place products 10 therein of varying heights or in multiple rows. For example, the first product compartment 390 may include two rows of products 10, while the second product compartment 400 may include three rows of products 10, and vice versa. Other components and other configurations may be used herein.

Figure 8:
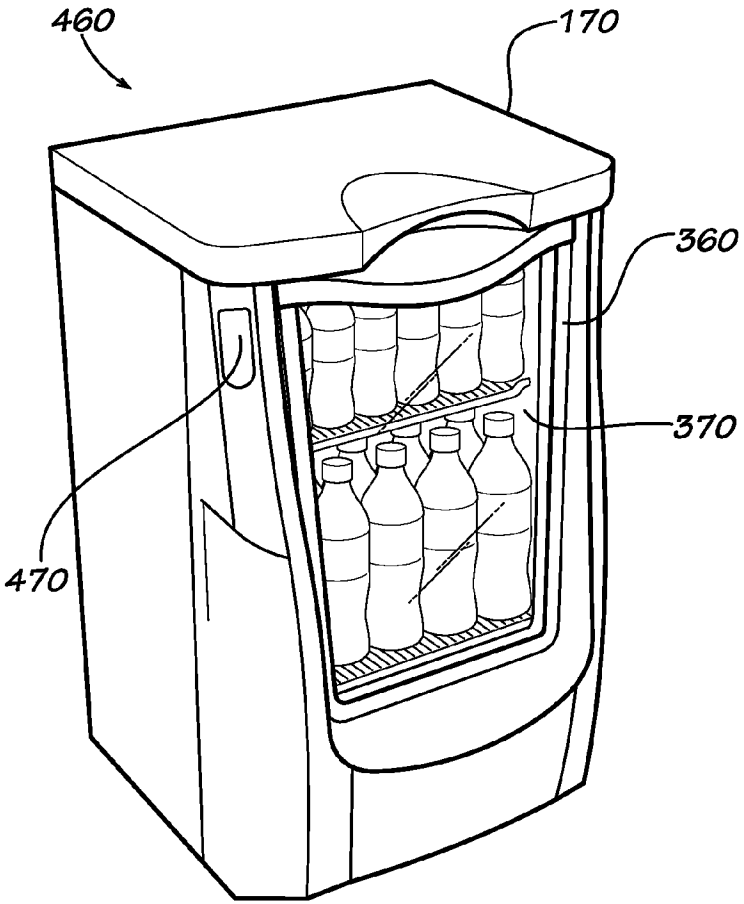
FIG. 8 is a front perspective view of a further embodiment of the chest cooler as may be described herein.

FIG. 8 shows a further embodiment of a chest cooler 460 as may be described herein. The chest cooler 460 may be substantially similar to those described above, but with the addition of a bottle opener 470 positioned thereon. The bottle opener 470 may be positioned anywhere about the outer frame 110. Other components and other configurations may be used herein.

Figure 9:
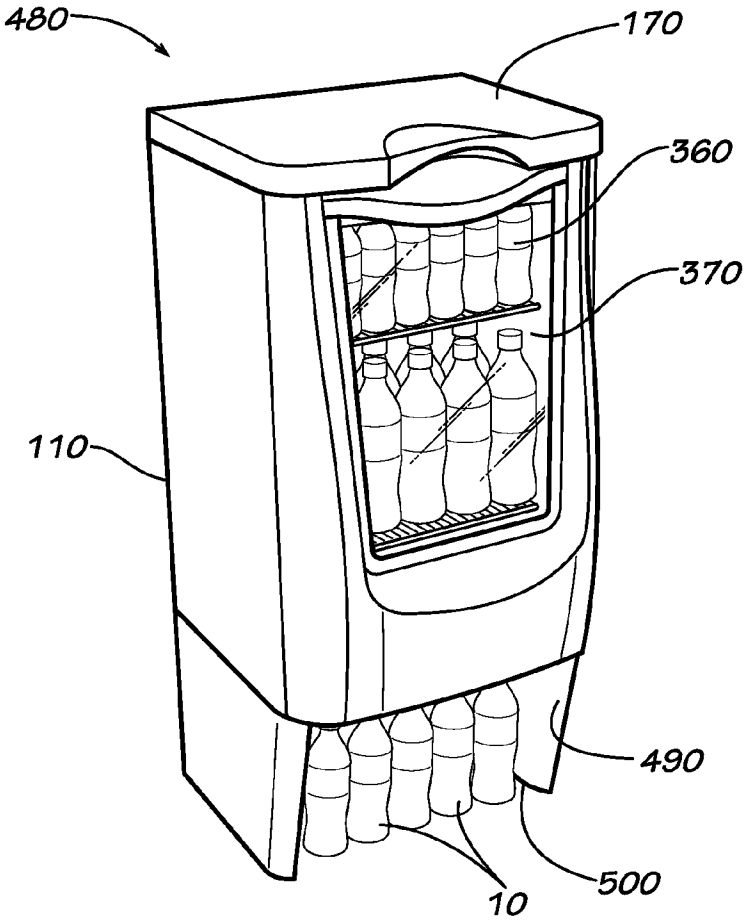
FIG. 9 is a front perspective view of a further embodiment of the chest cooler as may be described herein.

FIG. 9 shows a further embodiment of a chest cooler 480 as may be described herein. The chest cooler 480 may include a pedestal 490. The pedestal 490 may serve to elevate the outer frame 110 off of the ground. The pedestal 490 thus may be useful in areas that may be prone to flooding, dust, and/or other types of debris that may interfere with the operation of the chest cooler 480. Likewise, the pedestal 490 also may include a storage area 500 therein. The storage area 500 may be used to store product before positioning within the chest cooler 480 and/or provide space to return empty product containers and the like. The pedestal 490 and the storage area 500 may have any desired size or shape. Other components and other configurations may be used herein.

Figure 10:
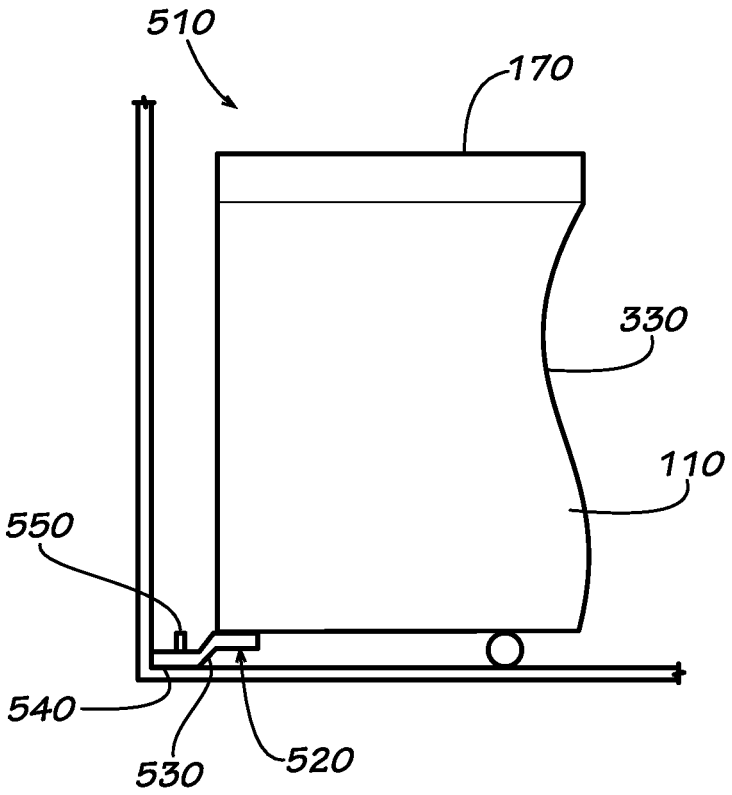
FIG. 10 is a side plan view of a further embodiment of the chest cooler as may be described herein.

FIG. 10 shows a further embodiment of a chest cooler 510 as may be described herein. The chest cooler 510 may be similar to those described above. The chest cooler 510 may include one or more anchors 520. The anchors 520 may have a predetermined height 530 and a predetermined length 540. The anchors 520 may be positioned on the ground and against a wall. The predetermined height 530 ensures that the outer frame 110 is at an adequate height from the ground. Likewise, the predetermined length 540 ensures that the outer frame 110 is at an adequate distance from a wall. The anchors 520 may be installed via bolts 550 or other types of fastening means. The anchors 520 also may be used with a pedestal 490. Other components and other configurations may be used herein.

The anchors 520 thus allow the chest cooler 510 to be positioned securely outside or elsewhere while ensuring proper positioning of the chest cooler 110. Such predetermined heights 530 and predetermined lengths 540 may provide adequate space for proper operation of the refrigeration device 120, may avoid flooding and the like, and/or may provide adequate visibility for the products 10 therein. Other types of securing devices also may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A chest cooler for dispensing a number of products, comprising:

an outer frame;

a plurality of vertically arranged product compartments within the outer frame;

a horizontal upper door; and a front door;

the front door comprising a transparent panel;

wherein some or all of the number of products are accessible via either the horizontal upper door or the front door and visible through the transparent panel; and wherein the front door and one or more of the plurality of vertically arranged product compartments comprise an offset orientation extending outwardly from a plane perpendicular with respect to the horizontal upper door.

2. The chest cooler of claim 1, wherein the plurality of vertically arranged product compartments comprises a first product compartment and a second product compartment.

3. The chest cooler of claim 2, wherein the horizontal upper door is positioned about the first product compartment and wherein the front door is positioned about the first product compartment and the second product compartment.

4. The chest cooler of claim 2, further comprising a front panel positioned about the first product compartment.

5. The chest cooler of claim 1, wherein one or more of the plurality of vertically arranged product compartments comprise a variable height product compartment.

6. The chest cooler of claim 5, wherein the variable height product compartment comprises a variable shelf and a plurality of variable shelf ledges.

7. A chest cooler for dispensing a number of products, comprising:

an outer frame;

a plurality of product compartments within the outer frame;

a horizontal upper door; and a front door;

the front door comprising a transparent panel;

wherein the front door and one or more of the plurality of product compartments comprise an offset orientation extending outwardly from a plane perpendicular with respect to the horizontal upper door.

8. The chest cooler of claim 1, wherein the outer frame comprises a bottle opener positioned thereon.

9. The chest cooler of claim 1, further comprising a pedestal and wherein the outer frame is positioned thereon.

10. The chest cooler of claim 9, wherein the pedestal comprises a storage area therein.

11. The chest cooler of claim 1, further comprising an anchor and wherein the anchor is attached to the outer frame.

12. The chest cooler of claim 11, wherein the anchor comprises a predetermined height and a predetermined length.

13. The chest cooler of claim 1, wherein the horizontal upper door and the front door comprise a gasket layer.

14. The chest cooler of claim 1, wherein the outer frame comprises messaging thereon.

15. The chest cooler of claim 1, wherein the outer frame comprises a contoured shape.

16. A chest cooler for dispensing a number of products, comprising:

an outer frame;

a refrigeration device with a compressor positioned within the outer frame;

a first product compartment within the outer frame;

a horizontal upper door positioned about the first product compartment;

a second product compartment within the outer frame and positioned underneath the first product compartment; and a front door positioned about the first product compartment and the second product compartment;

the front door comprising a transparent panel;

the front door and the second product compartment comprising an offset orientation extending outwardly from a plane perpendicular with respect to the horizontal upper door;

wherein some or all of the number of products are accessible via either the horizontal upper door or the front door and visible through the transparent panel.

17. The chest cooler of claim 16, wherein the first product compartment and the second product compartment comprise variable height product compartments.

18. The chest cooler of claim 17, wherein the variable height product compartments comprise a variable shelf and a plurality of variable shelf ledges.

19. The chest cooler of claim 17, wherein the first product compartment and the second product compartment comprise a slanted orientation extending upwardly towards the front door.

20. The chest cooler of claim 16, wherein the outer frame comprises a contoured shape.

* * * * *